US012410571B2

(12) United States Patent
Côté et al.

(10) Patent No.: US 12,410,571 B2
(45) Date of Patent: Sep. 9, 2025

(54) GROUND FOLLOWING SNOW PLOW ATTACHMENT

(71) Applicant: 9091-4532 Québec inc., L'Isle-Verte (CA)

(72) Inventors: Alexandre Côté, L'Isle-Verte (CA); Etienne Côté, L'Isle-Verte (CA)

( * ) Notice: Subject to any disclaimer, the term of this patent is extended or adjusted under 35 U.S.C. 154(b) by 579 days.

(21) Appl. No.: 17/778,794

(22) PCT Filed: Feb. 1, 2021

(86) PCT No.: PCT/CA2021/050112

§ 371 (c)(1),
(2) Date: May 20, 2022

(87) PCT Pub. No.: WO2021/151215

PCT Pub. Date: Aug. 5, 2021

(65) Prior Publication Data

US 2022/0412026 A1 Dec. 29, 2022

Related U.S. Application Data

(60) Provisional application No. 62/968,519, filed on Jan. 31, 2020.

(51) Int. Cl.
*E01H 5/06* (2006.01)

(52) U.S. Cl.
CPC ..... *E01H 5/063* (2013.01)

(58) Field of Classification Search
CPC ..... E01H 5/063
(Continued)

(56) References Cited

U.S. PATENT DOCUMENTS 3,587,751 A 6/1971 Schmidt, Jr.
3,626,614 A 12/1971 Kahlbacher
(Continued)

FOREIGN PATENT DOCUMENTS

CN 114232549 A * 3/2022 ..... E01H 5/06
DE 3911734 1/1992
(Continued)

OTHER PUBLICATIONS

International Search report, Marie-Claude Gagnon, Mar. 30, 2021,14 pages.
Kage Innovation LLC, Kage —2017 Plow Systems, 2017, 16 pages.

*Primary Examiner* — Gary S Hartmann
(74) *Attorney, Agent, or Firm* — Benoit & Cote Inc.; Mathieu Audet

(57) ABSTRACT

An attachment assembly for attaching a snow plow blade to a vehicle includes a pair of interface brackets, a pair of articulated intermediate structures mounted to the interface brackets, a transversal member joining the intermediate structures, and a trigger assembly. The trigger assembly includes a static member with a pivoting attachment point for attachment to the snow plow blade and top and bottom attachment points for releasable attachment to the intermediate structure, a pin assembly, and a biasing means attached to the pin assembly and to the static member. The trigger assembly is biased toward a default position in which the pin member and the static member are at their closest. When applying a torque on the snow plow blade above a trigger threshold, the snow plow blade rotates from the default position to a triggered position.

15 Claims, 10 Drawing Sheets

(58) Field of Classification Search
USPC ..... 37/232
See application file for complete search history.

(56) References Cited

U.S. PATENT DOCUMENTS

| | | | |
|---|---|---|---|
| 4,356,645 | A | 11/1982 | Hine et al. |
| 6,618,965 | B1 | 9/2003 | Schultz et al. |
| 6,709,223 | B2 | 3/2004 | Walto et al. |
| 6,931,771 | B1 | 8/2005 | Liebl |
| 6,988,560 | B2 | 1/2006 | Bay |
| 9,255,370 | B2 | 2/2016 | Paonessa |
| 2003/0108414 | A1 | 6/2003 | Walto et al. |
| 2003/0175105 | A1 | 9/2003 | Hilvers et al. |
| 2004/0009057 | A1 | 1/2004 | Branham |
| 2005/0016033 | A1 | 1/2005 | Schmeichel |
| 2010/0106344 | A1 | 4/2010 | Edwards |
| 2017/0370069 | A1 | 12/2017 | Guggino et al. |
| 2020/0217047 | A1 | 7/2020 | Sherlock |

FOREIGN PATENT DOCUMENTS

| | | | | |
|---|---|---|---|---|
| DE | 4018832 | B4 * | 12/2009 | ..... E01H 5/063 |
| DE | 102011015245 | | 1/2012 | |
| EP | 0007000 | | 1/1984 | |
| GB | 946779 | | 1/1964 | |
| KR | 100369931 | B1 * | 1/2003 | ..... E01H 5/066 |

* cited by examiner

GROUND FOLLOWING SNOW PLOW ATTACHMENT

CROSS-REFERENCE TO RELATED APPLICATION

This application claims priority from U.S. provisional patent application 62/968,519 filed Jan. 31, 2020, the specification of which is hereby incorporated herein by reference in its entirety.

BACKGROUND

(a) Field

The present invention generally relates to blades for snow plows, and more particularly relates to snow plow blades assemblies and attachment assemblies for snow plow blades that comprise mechanisms capable to adapt to the unevenness of the ground.

(b) Related Prior Art

Snow plows are both well-known and each has a relatively long snow plow blade assembly which extends generally laterally of the surface being worked on. Some of them comprise sidewalls that retain the snow sideways, allowing to controllably displace more snow before having an overflow flowing out sideways of the snow plow blade assembly.

Further, the ground the snow plow tries to clean is by nature not always even. In order to optimize the process of grading the ground with the snow plow, the snow plow blade should be able to adapt to the changes of slope of the ground, not only in the direction of the grading but also transversally to the grading.

There is therefore a need for a solution for the snow plow blade assembly to automatically adapt to the unevenness of the ground while maintaining the main characteristics of the snow plow comprising the capacity to lift the snow plow blade assembly, the stability of the snow plow blade assembly both in grading operation and when lifted above the ground, and the other controls regarding the snow plow blade assembly, There is further a need for a solution for the snow blade assembly to decrease the impact resulting from hitting an obstacle, more specifically undergone by the snow plow blade assembly itself and by the vehicle on which is mounted the snow plow blade assembly, thereby decreasing premature wear that may result from these impacts.

Therefore, there is a need for an improved mechanism for snow plow blade assemblies that better respond to these objectives.

SUMMARY

According to an embodiment, there is provided an attachment assembly for attaching a snow plow blade to a vehicle, comprising: an interface bracket adapted for releasable connection with the vehicle; an intermediate structure mounted to the interface bracket; and a trigger assembly comprising: a static member comprising a pivoting attachment point, a top attachment point and a bottom attachment point, the pivoting attachment point for pivoting attachment to the snow plow blade, and the top and bottom attachment points for releasable attachment to the intermediate structure; a pin assembly; and a biasing means attached, at one end, to the pin assembly and attached, at an other end, to the static member such that the trigger assembly is biased toward a default position in which the pin member and the static member are at their closest, wherein when applying a torque on the snow plow blade above a trigger threshold, the snow plow blade rotates from the default position to a triggered position.

According to an aspect, the static member comprises a bottom end area and a top end area distal from the bottom end area, wherein the top attachment point is in the top end area and the bottom attachment point and the pivoting attachment point are in the bottom end area.

According to an aspect, the static member comprises an anchoring point in the bottom end area and to which the other end of the biasing means is attached.

According to an aspect, the one end of the biasing means is attached to the pin assembly forward of and above the bottom attachment point.

According to an aspect, the pin assembly comprises a pin member and a sleeve in which the pin member is releasably secured.

According to an aspect, the pin assembly further comprises an eyebolt to which the one end of the biasing means is attached.

According to an aspect, the eyebolt is adjustable in length relative to the pin member and thereby adjusts a force exerted by the biasing means.

According to an aspect, the intermediate structure comprising an articulated assembly.

According to an aspect, the static member has a distal end distant from the pivoting attachment, wherein the articulated assembly comprises a rear longitudinal blade, a front longitudinal blade pivotably mounted to the rear longitudinal blade, and a top link arm, and further wherein the front longitudinal blade is releasably attached to the pivoting attachment, the rear longitudinal blade is mounted to the interface bracket and the top link arm is releasably attached to the distal end of the static member and pivotably mounted to the interface bracket.

According to an aspect, the top link arm is located above the front longitudinal blade.

According to an embodiment, there is provided a trigger assembly for connecting a snow plow blade to an interface bracket, via an intermediate structure, the interface bracket for releasable connection to a vehicle, the trigger assembly comprising: a static member comprising a pivoting attachment point, a top attachment point and a bottom attachment point, the pivoting attachment point for pivoting attachment to the snow plow blade, and the top and bottom attachment points for releasable attachment to the intermediate structure; a pin assembly; and a biasing means attached, at one end, to the pin assembly and attached, at an other end, to the static member such that the trigger assembly is biased toward a default position in which the pin member and the static member are at their closest, wherein when applying a torque on the snow plow blade above a trigger threshold, the snow plow blade rotates from the default position to a triggered position.

According to an aspect, the static member comprises a bottom end area and a top end area distal from the bottom end area, wherein the top attachment point is in the top end area and the bottom attachment point and the pivoting attachment point are in the bottom end area.

According to an aspect, the static member comprises an anchoring point in the bottom end area and to which the other end of the biasing means is attached.

According to an aspect, the one end of the biasing means is attached to the pin assembly forward of and above the bottom attachment point.

According to an aspect, the pin assembly comprises a pin member and a sleeve in which the pin member is releasably secured.

According to an aspect, the pin assembly further comprises an eyebolt to which the one end of the biasing means is attached.

According to an aspect, the eyebolt is adjustable in length relative to the pin member and thereby adjusts a force exerted by the biasing means.

According to an embodiment, there is provided an attachment assembly for attaching a snow plow blade to a vehicle, comprising: a pair of interface brackets adapted to be releasably secured to the vehicle; a pair of intermediate structures, wherein each one of the pair of intermediate structures comprises an articulated assembly comprising an axis in a transversal orientation, wherein the articulated assembly comprises a rear longitudinal blade, a front longitudinal blade pivotably mounted to the rear longitudinal blade about the axis, and a top link arm; and a transversal member joining the pair of intermediate structures in the transversal orientation.

According to an aspect, the top link arm comprises a top face having a downward curvature.

According to an aspect, the front longitudinal blade is releasably attached to the snow plow blade, the rear longitudinal blade is mounted to a respective one of the pair of interface brackets and the top link arm is releasably attached to snow plow blade and pivotably mounted to the rear longitudinal blade.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which:

FIGS. 10A and 10B are side views of a portion of the attachment assembly depicting the interaction between the front blade and the second transversal member, wherein FIG. 10A depicts both of the front blades in intermediary positions while FIG. 10B depicts the frontmost front blade in an elevated blade position and the rearmost front blade in a lowered blade position.

It will be noted that throughout the appended drawings, like features are identified by like reference numerals.

DETAILED DESCRIPTION

Figure 1:
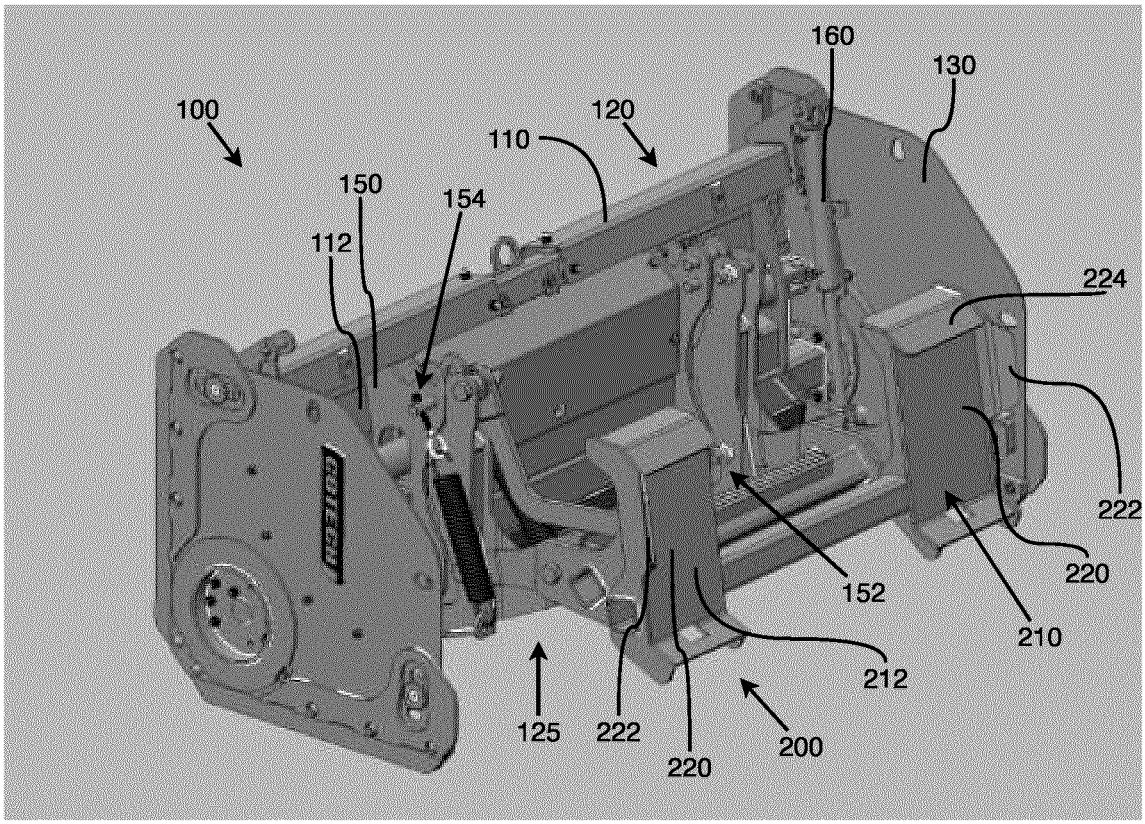
FIG. 1 is a perspective rear view of the attachment assembly with a snow plow blade mounted thereto in accordance with an embodiment.

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

The terms "top", "up", "upper", "bottom", "lower", "down", "vertical", "horizontal", "interior" and "exterior" and the like are intended to be construed in their normal meaning in relation with normal installation of the product, with indication of "front" referring to the extremity of the vehicle on which the snow plow blade assembly is mounted to, "longitudinal" to the general orientation rear-front of the vehicle, and "transversal" to the orientation perpendicular to longitudinal along an horizontal plane. indication of "down" refers to the direction toward the ground.

It should further be noted that for purposes of this disclosure, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

In realizations, there are disclosed components of a snow plow and more particularly of a snow plow blade assembly, aka blade assembly.

It will be noted that throughout the appended drawings, like features are identified by like reference numerals.

Figure 2:
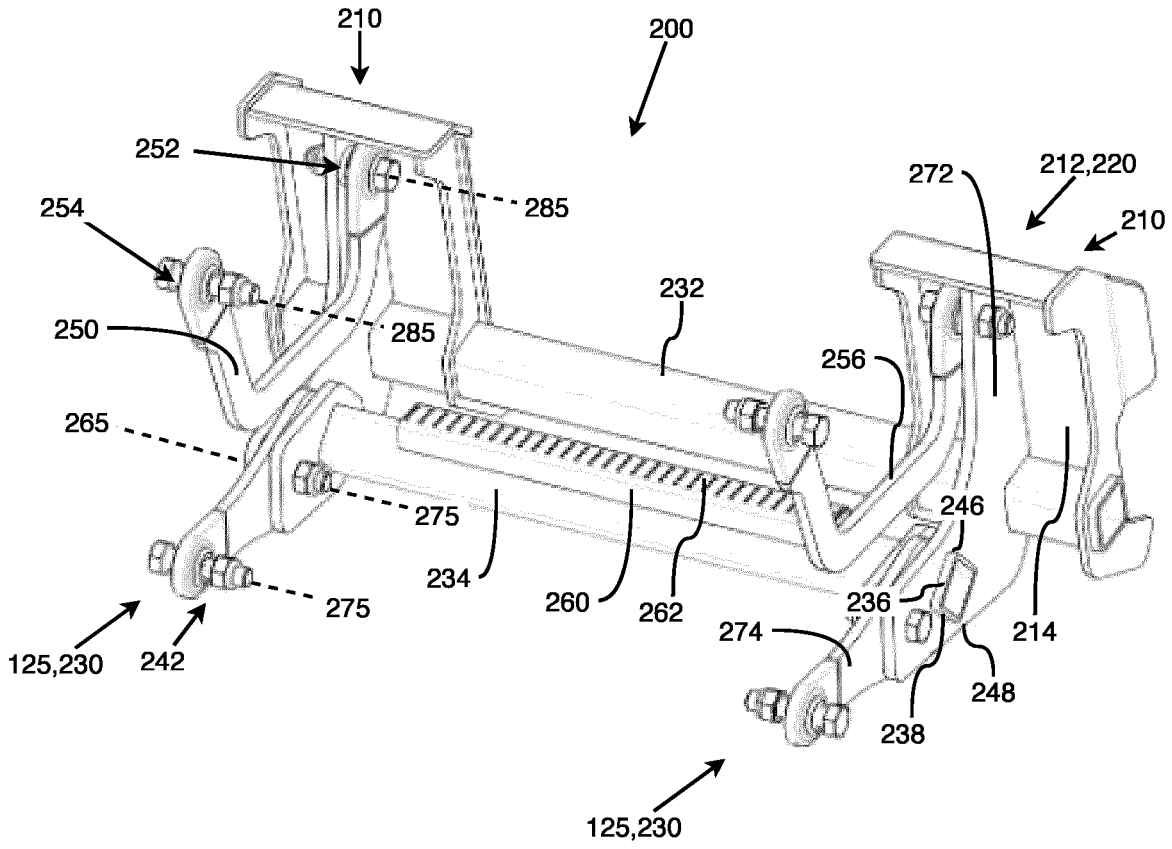
FIG. 2 is a perspective front view of the attachment assembly of FIG. 1 without a snow plow blade mounted thereto.
Figure 5:
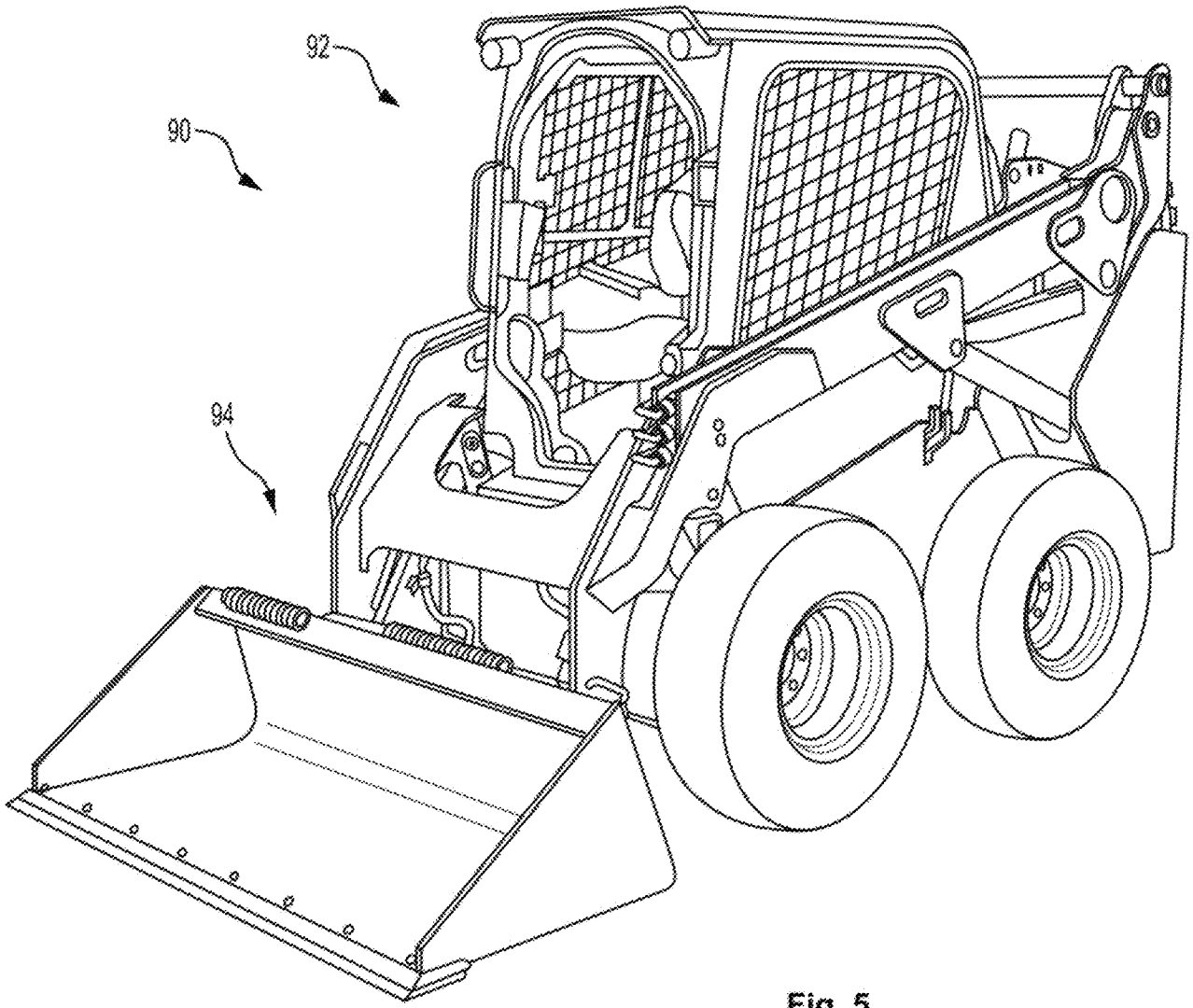
FIG. 5 is a picture depicting an example of a skid steer loader operable with the attachment assembly of FIGS. 1 and 2.

Referring now to the drawings, and more particularly to FIGS. 1 and 2, a snow plow blade assembly 100 is adapted to be mounted to a snow plow (not depicted) of the type of a skid steer loader 90 (see FIG. 5) or another vehicle of similar attachment configuration.

The configuration of the skid steer loader 90 is adapted for the operator to pass in front and between the forks / hydraulic arms to enter the driving cabin 92. Further, the skid steer loader 90 is a polyvalent vehicle that must be able to perform multiple operations, and thus be able to operate with a variety of tools, including a snow plow blade assembly 100. Thus, the present snow plow blade assembly 100 must both be able to be easily mounted to and dismounted from the skid steer loader 90 and further must provide the clearance for the operator of the skid steer loader 90 to relatively easily enter and exit the cabin 92 without having to dismount the snow plow blade assembly 100 from the skid steer loader 90.

The snow plow blade assembly 100 comprises on its rear wall 112 a pair of holder assemblies 150 adapted for the attachment of the blade 110 to the attachment assembly 200 itself mounted to the skid steer loader 90.

The snow plow blade assembly 100 comprises a central section 120 and, on each side, a sidewall 130 mounted to the central section 120.

The snow plow blade assembly 100 further comprises one or more hydraulic jacks 160 that may be adapted to control configurations of snow plow bade assembly 100, such as the width of the snow plow blade assembly 100, the position of the sidewalls 130 relative to the central section 120, etc., with the hydraulic jacks 160 being connected to the hydraulic power of the skid steer loader 90.

Referring particularly to FIGS. 1 and 2, the attachment assembly 200 comprises a pair of interface brackets 210 adapted to interface with the fork interfaces 94 of the skid steer loader 90. The interface brackets 210 comprise on their rear face 212 interfacing walls 220 contacting the fork interfaces 94 such as the interface brackets 210 and the fork interfaces 94 are secured to each other, allowing to operate the snow plow blade assembly 100, which comprises pushing, pulling, lifting and lowering the snow plow blade assembly 100 without the interface between the skid steer loader 90 and the snow plow blade assembly 100 being released.

The interface brackets 210 comprise an interface wall 220 and a side wall 222 extending rearward from the interface walls, wherein the interface walls 220 define an interface plane limited transversally by the side walls 222. The interface brackets 210 also comprise a top wall 224 extending rearward from the interface wall 220.

The attachment assembly 200 consists of a single rigid structure adapted to interface with the skid steer loader 90 that remains whole when either or both of a) the attachment assembly 200 is dismounted from the skid steer loader 90 or b) no snow plow blade 110 is mounted to the attachment assembly 200.

The attachment assembly 200 comprises, on each side, mounted to the front face 214 of the respective interface bracket 210, an intermediate structure 125. In the described realization, both intermediate structures 125 comprise an articulated assembly 230.

The attachment assembly 200 comprises a first transversal member 232 joining the intermediate structures 125 about the interface brackets 210. According to the depicted realization, the first transversal member 232 is also mounted to the interface brackets 210 for increased rigidity.

The first transversal member 232 is typically made of a hollow beam providing a channel for hydraulic hoses (see FIG. 7 for example) to travel therethrough.

The two articulated assemblies 230 are further joined by a second transversal member 234 providing the desired rigidity to the attachment assembly 200.

According to a realization, the attachment assembly 200 comprises, mounted to the top of the second transversal member 234, a step member 260 featuring a non-slippery top face 262 adapted for the operator of the skid steer loader 90 to step on when entering or exiting the cabin 92 of the skid steer loader 90.

The articulated assemblies 230 comprise at their front a low mounting component 242 adapted for the lower portion 152 of a respective holder assembly 150 to be attached thereto.

The articulated assemblies 230 further comprise a top link arm 250 which is mounted distant from the front longitudinal blade 274 and the rear longitudinal blade 272. Each one of the top link arms 250 is attached at a rear junction 252 to the front face 214 of a respective interface bracket 210 and at its front junction 254 to the top portion 154 of the respective holder assembly 150. At least one, but preferably both attachments of the top link arms 250 are pivotably mounted to their respective mounting components. The top link arms 250 provide a fixed-length attachment between the front face 214 of the interface brackets 210 and the rear wall 112 of the blade 110 while allowing modification of the angle between the interface brackets 210 and the snow plow blade 110.

The top link arms 250 feature a top face 256 having a downward curvature (e.g., a U-shape link arm). The downward curvature of the top face 256 results in each of the top link arm 250 extending above and about their respective articulated assembly 230, and thereby providing clearance over the top face 256 for the operator of the skid steer loader 90 to easily travel in and out of (i.e., enter and exit) the space delimited by the attachment assembly 200 with limited efforts; the operator having no surface to climb and the components to step over being kept closer to the ground.

According to a realization, the top face 256 of the top link arms 250 feature a U-shape, extending downward close to the front face 214 of the interface brackets 210 and to the rear wall 112 of the blade 110, and extending about horizontal in-between above the articulated assemblies 230.

Each one of the articulated assemblies 230 comprises a rear blade 272 (aka rear longitudinal blade) and a front blade 274 (aka front longitudinal blade) extending longitudinally from the front face 214 of the interface bracket 210 to the low portion of the holder assembly 150, with the front blade 274 being pivotably mounted to the holder assembly 150.

The rear blade 272 and the front blade 274 are pivotably mounted to each other at an axis 265, participating in a first articulation 275 between the interface brackets 210 and the blade 110. The pivot mountings of the top link arms 250 provide a second articulation 285 between the interface brackets 210 and the blade 110.

Figure 6:
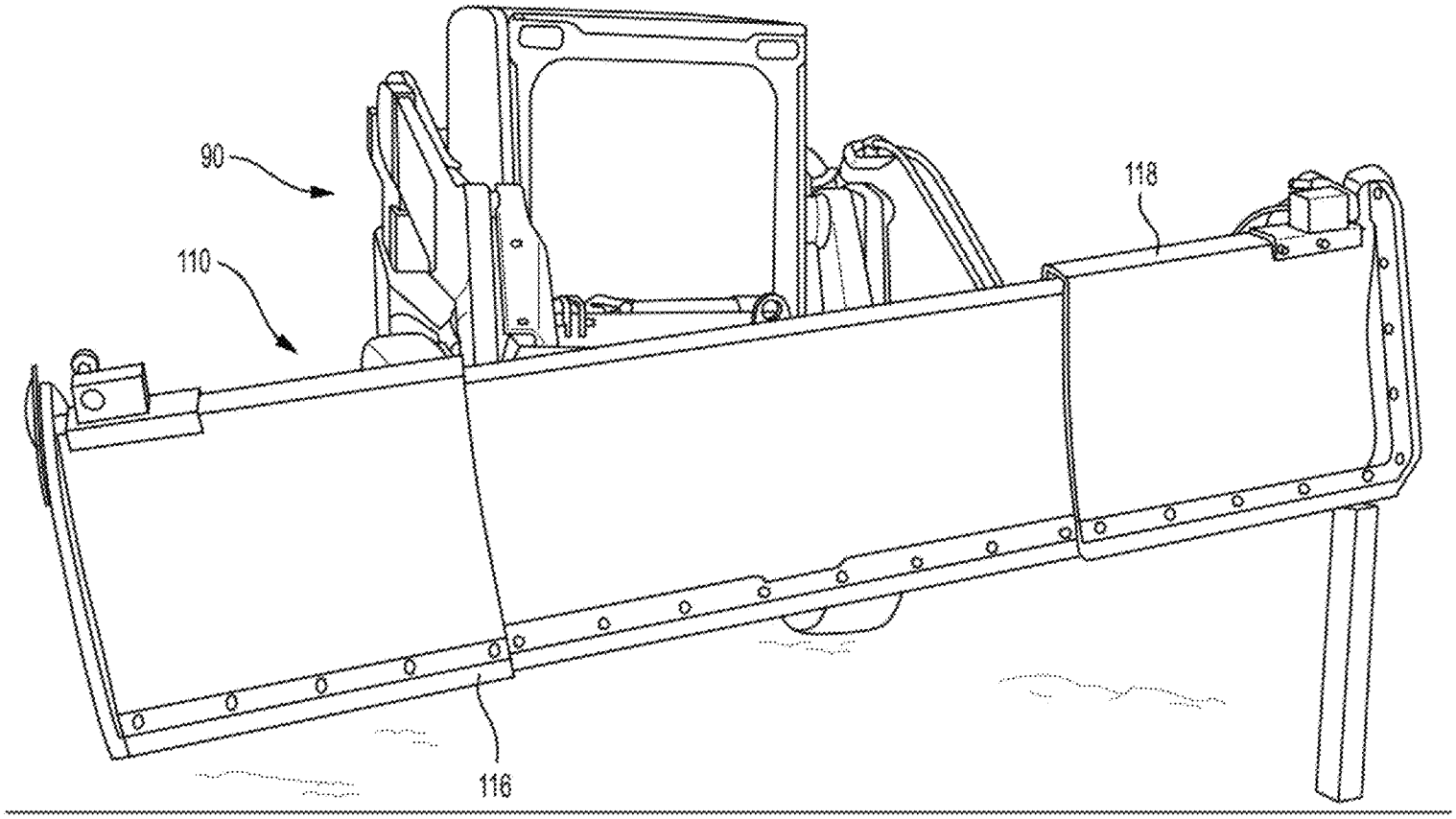
FIG. 6 is a picture of the front view of a skid steer loader with a snow plow blade assembly mounted thereto, wherein the picture depicts the position of a snow plow blade mounted to the attachment assembly of FIGS. 1 and 2 with the snow plow blade shown supported on a single side simulating an uneven ground surface.
Figure 7:
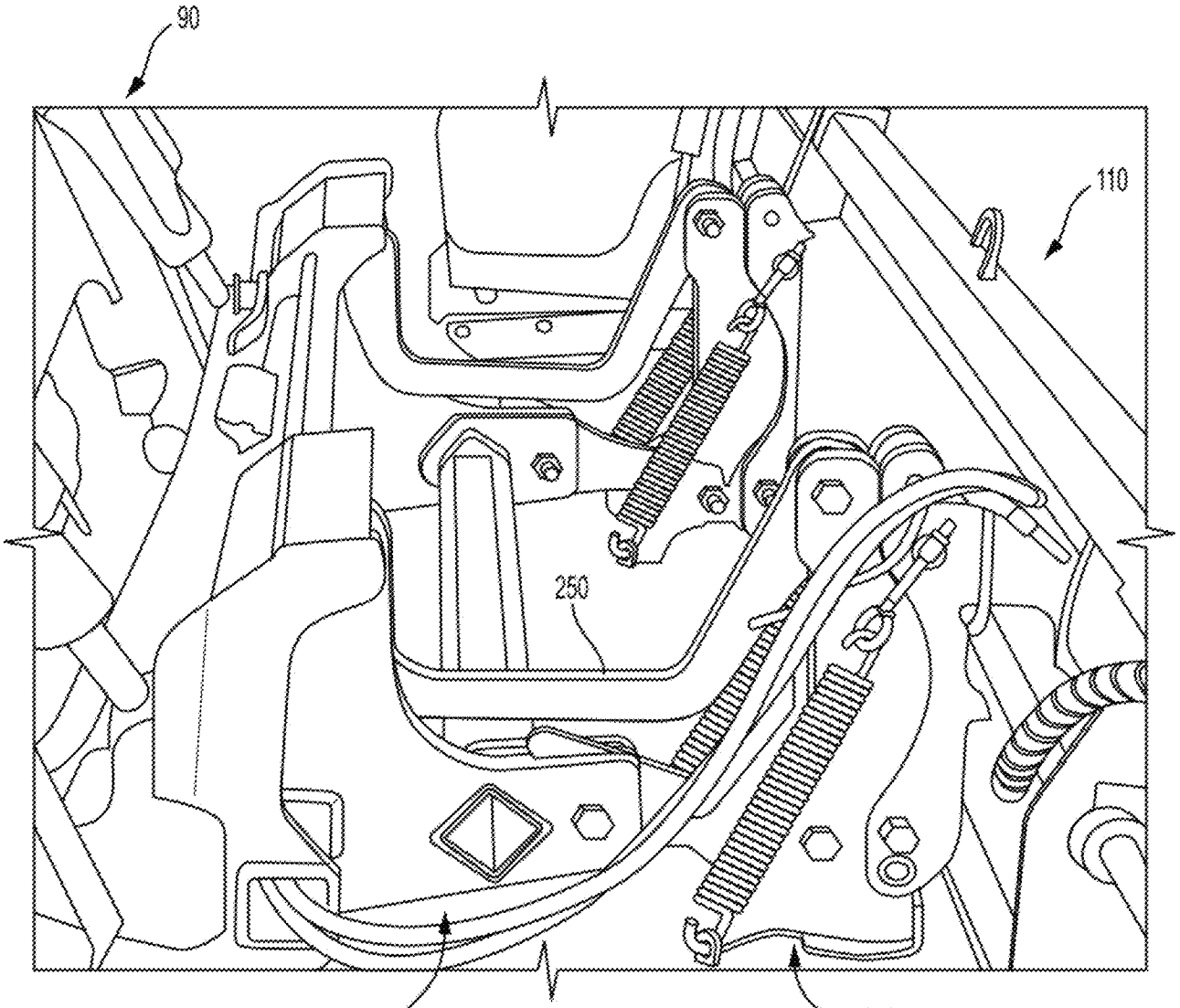
FIG. 7 is a picture of the side of the attachment assembly installed on a skid steer loader illustrating the articulated assemblies operating independently from each other.
Figure 8:
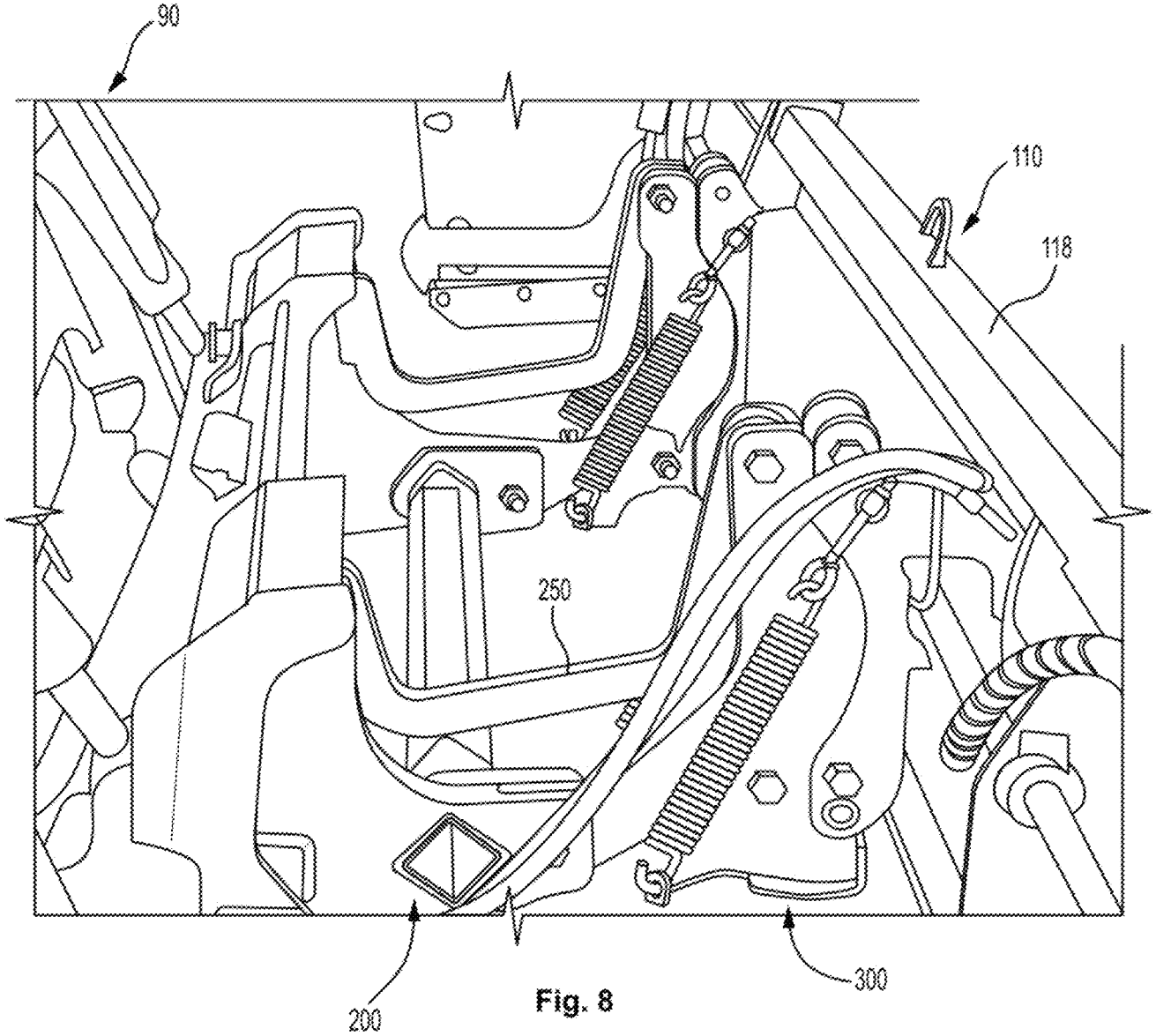
FIG. 8 is a picture of the side of the attachment assembly installed on a skid steer loader illustrating the trigger assembly in the default position.
Figure 9:
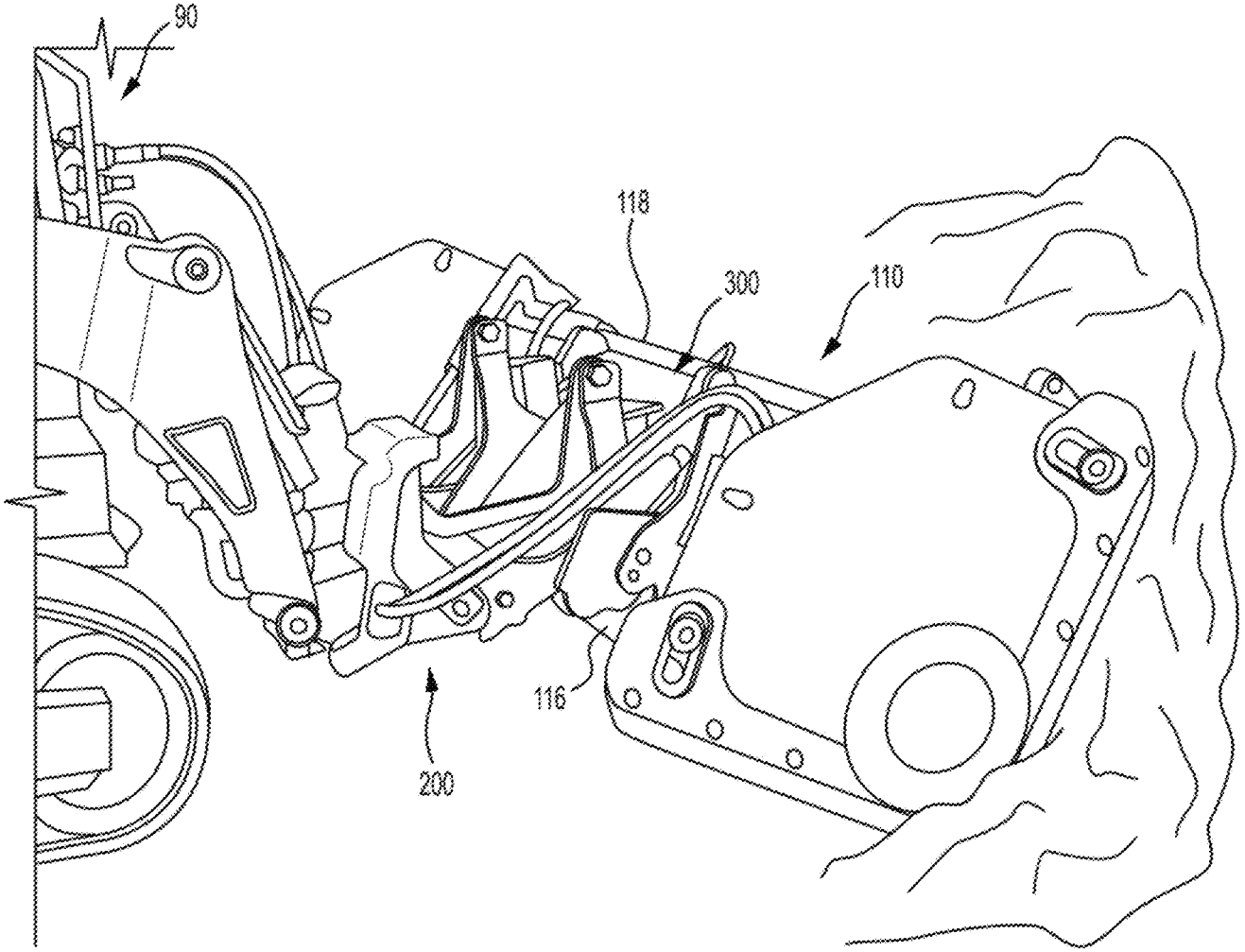
FIG. 9 is a picture of the side of the attachment assembly installed on a skid steer loader illustrating the trigger assembly in the triggered position.

Referring additionally to FIGS. 6 and 7, one must note that the articulations 275, 285 of the attachment assembly 200 on the left side operate independently from the articulations 275, 285 of the attachment assembly 200 on the right side. Accordingly, in response to unevenness of the ground, the articulations 275, 285 on one side (e.g., the left side) of the snow plow blade assembly 100 allows the left side of the snow plow blade 110 to move up or down without the right side of the snow plow blade 110 moving up or down; the position of the right side of the snow plow blade 110 is subject to the straight configuration of the snow plow blade 110 and of the configuration of its ground-contacting edge 116 and not of a displacement forced by the articulations 275, 285 on the right side.

Figure 10A:
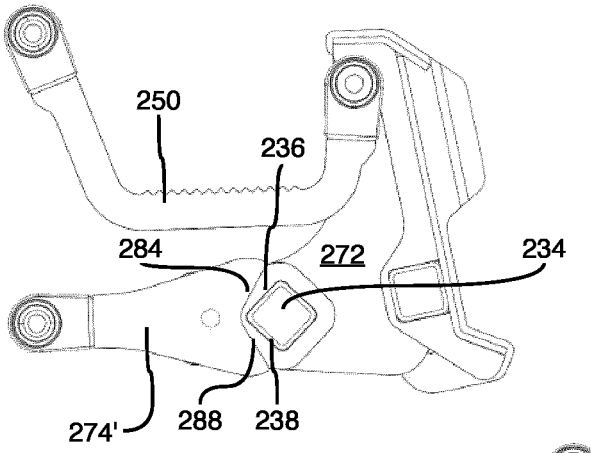
Figure 10B:
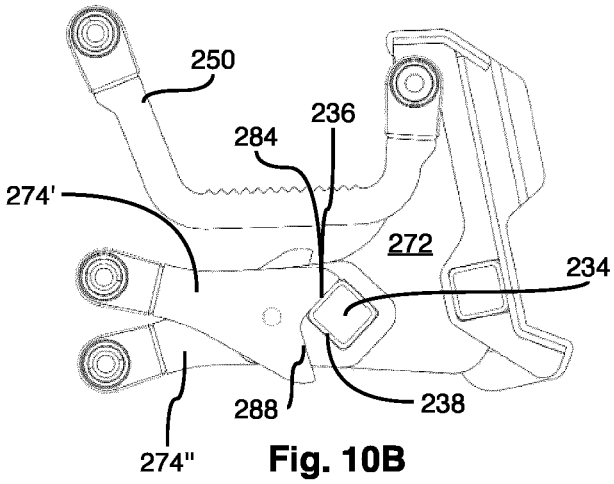

Referring additionally to FIGS. 10A and 10B, the front blade 274 comprises a top limit face 284 and bottom limit face 288 extending rearward from the pivoting attachment of the front blade 274 to the rear blade 272. The limit faces 284 and 288 extend about the second transversal member 234. The top limit face 284 is facing substantially downward while the bottom limit face 288 is facing substantially upward. The first limit face and the second limit face have a clearance in-between where is housed at least a portion of the second transversal member 234 acting as a rotation limit component cooperating with the top jaw and the bottom jaw. When the blades 272, 274 rotate relative to each other, one of the top limit face 284 and the bottom limit face 288 approaches the second transversal member 234 and, at the limit of the displacement of the snow plow blade 110 relative to its mounting to the skid steer loader 90, abuts the second transversal member 234, thereby limiting the displacement of the snow plow blade 110 within the limits of the articulated assembly 230.

According to a realization, the second transversal member 234 features a pair of sloped front faces 236, 238, providing maximum range for pivoting of the articulation 275 requiring a minimal clearance between the top limit face 284 and the bottom limit face 288 and a minimal distance between the axis 265 and the second transversal member 234.

FIGS. 10A and 10B are side views depicting the interaction between the front blade 274 and the sloped faces 236 and 238 of the second transversal member 234, with the rear blade 272 not depicted for the sake of clarity. FIG. 10A depicts when both of the frontmost front blade 274' and the rearmost front blade 274" (hidden behind) are in intermediary positions, aka when the top limit face 284 and the bottom limit face 288 are not contacting the sloped faces 236 and 238. FIG. 10B depicts the frontmost front blade 274' in an elevated blade position and the rearmost front blade 274" in a lowered blade position. In the elevated blade position, the contact between the sloped face 236 and the limit face 284 limits further pivoting of the rear blade 272 and of the front blade 274 relative to each other. In the lowered blade position (partially hidden), the contact between the sloped face 238 and the limit face 288 limits further pivoting of the rear blade 272 and the front blade 274" relative to each other.

It is to be noted, as depicted, that the pivoting of the left and of the right front blade/rear blade assemblies are independent from each other.

According to realizations, the top and bottom limit faces 284, 288 abuts at the limit of the articulation 275 either one of the sloped faces 236, 238 or one of the apexes 246, 248, i.e., top and lowest portions, of the second transversal member 234.

According to a realization, the limit faces 284, 288 consist in a single arched face comprising a top component and an abutting component capable of abutting faces of the second transversal member 234.

According to a realization, the angle between the sloped faces 236, 238 is of about ninety (90) degrees, with the angles being about symmetrical (forty-five (45) degrees above and forty-five (45) degrees below) relative to a plane about the horizontal when the snow plow blade 110 is contacting horizontal ground.

Figure 11:
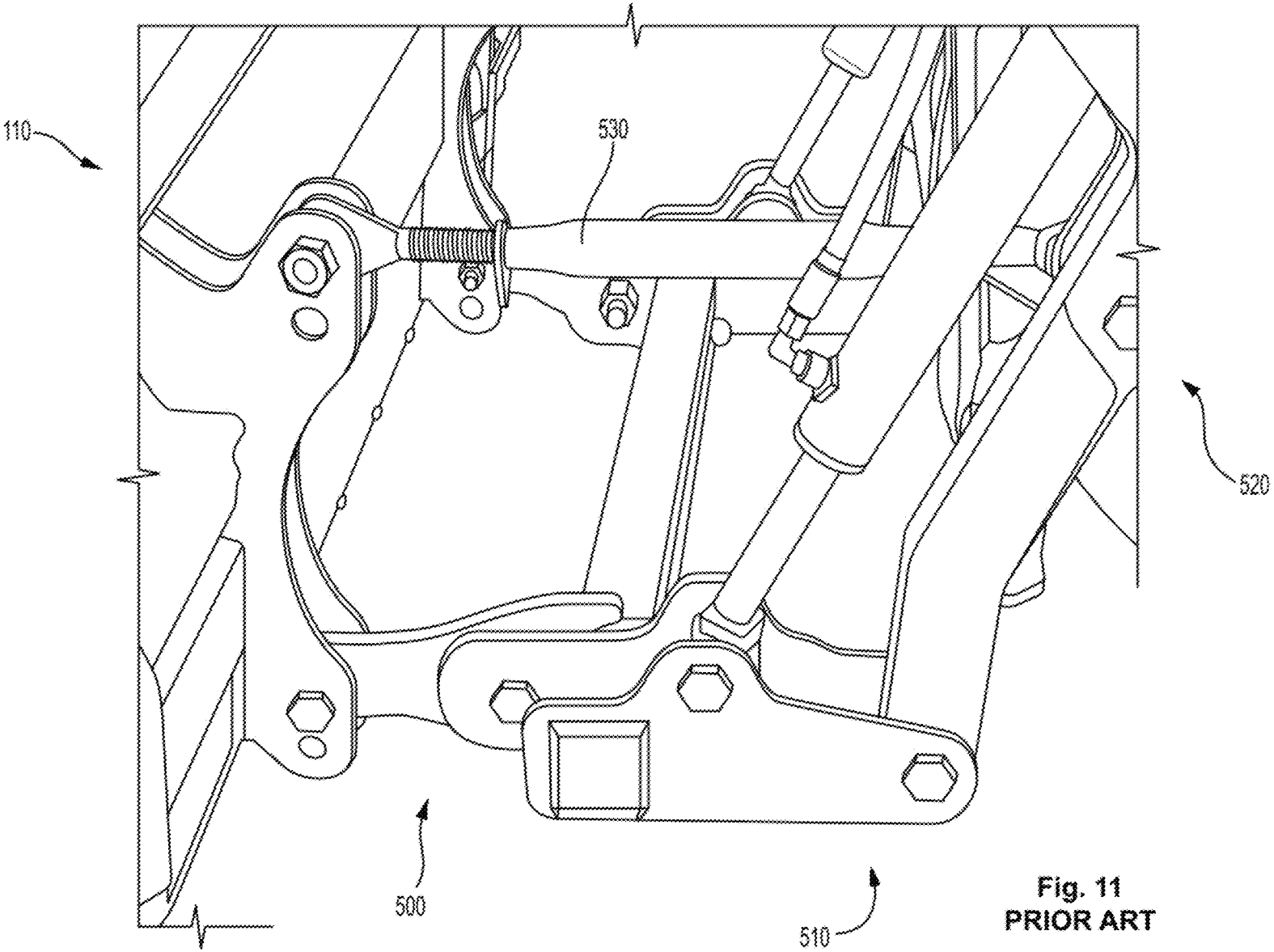
Fig. 11 PRIOR ART
FIG. 11 is a picture of the side of an attachment assembly of the PRIOR ART.

Referring for comparison to the assembly of the PRIOR ART depicted on FIG. 11, the attachment assembly of the PRIOR ART 500 must be mounted to multiple points to the vehicle, more precisely comprising a first mounting component 510 mounted to the bottom of the vehicle arm and a second mounting component 520 mounted to about the middle of the vehicle arm. The attachment assembly of the PRIOR ART 500 a) does not feature a simple and rigid structure that is easy to mount to the vehicle, and b) does not provide clearance for the operator to enter in the space delimited between the snow plow blade 110 and the vehicle without much efforts since it requires the operator to climb over the highest arm 530 or to pass over the snow plow blade 110 to reach this delimited space. Numerous additional advantages result from the hereindescribed attachment assembly 200 when compared to the attachment assembly of the PRIOR ART 500.

Referring now additionally to FIGS. 3, 4, 8 and 9, the snow plow blade assembly 100, in some realizations, comprises a trigger assembly 300 capable of interfacing on the rear side with the intermediate structure 125 and on the front side with the holder assemblies 150 of the snow plow blade 110. The trigger assembly 300 is adapted for the blade 110, upon hitting a non-moveable object about the ground, thus upon undergoing a torque above a trigger threshold, to have the snow plow blade 110 moving from a default position (see FIG. 8) to a triggered position (see FIG. 9) through which the stopping of the vehicle (e.g., skid steer loader 90) from its forward motion is dampened by the displacement of the snow plow blade 110.

One should note that the trigger assembly 300 comprises a similar attachment interface on its rear to the holder assembly 150 and a similar attachment interface on its front to the attachment assembly 200, thereby allowing to have realizations with trigger assemblies 300 and realizations free of trigger assemblies 300 comprising the same attachment assembly 200 and snow plow blade 110.

The trigger assembly 300 comprises a static member comprising a nested arm 310, an external arm 320, a pivoting attachment point 330 for rotative attachment to the snow plow blade. The trigger assembly 300 further comprises biasing means 340 (e.g., extendable springs 340).

It should be noted that, according to an embodiment, the external arm 320 has top end attachment point 336 in a top end area distant from the pivoting attachment point 330. Still according to this embodiment, the front longitudinal blade 274 is releasably attached to the bottom attachment point 332, the rear longitudinal blade 272 is mounted to the interface bracket 210 and the top link arm 250 is releasably attached to the top end attachment point 336 of the external arm 320 and pivotably mounted to the interface bracket 210.

The trigger assembly 300 comprises a pivoting attachment point 330 in a bottom area of the static member which is releasably attached at the bottom to the snow plow blade 110. According to realizations, the nested arm 310 is mounted to/interfaced with the snow plow blade 110 at a first height and the external arm 320 is mounted to/interfaced to the snow plow blade 110 at a second height greater than the first height.

The trigger assembly 300 comprises at the bottom end area an extension plate 342 extending rearward and comprising apertures (aka an anchoring point 344) rearward to the pivoting attachment point 330 for attachment of the bottom extremity of the extendable springs 340.

It is to be noted that, in its default configuration, the extendable spring 340 is mounted to the external arm 320 rearward to the pivoting attachment point 330 and is mounted to the pin assembly in front and higher than where it is attached to the external arm 320 (e.g., at the anchoring point 344). This configuration provides the tension necessary for the trigger assembly 300 to return to the default configuration upon release of the external torque.

One should note that the external arm 320 and the extension plate 342 are static relative to each other. Another realization (see FIG. 7 for example) comprises a single static member performing both functions of the assembly comprising the depicted external arm 320 and extension plate 342.

Figure 3:
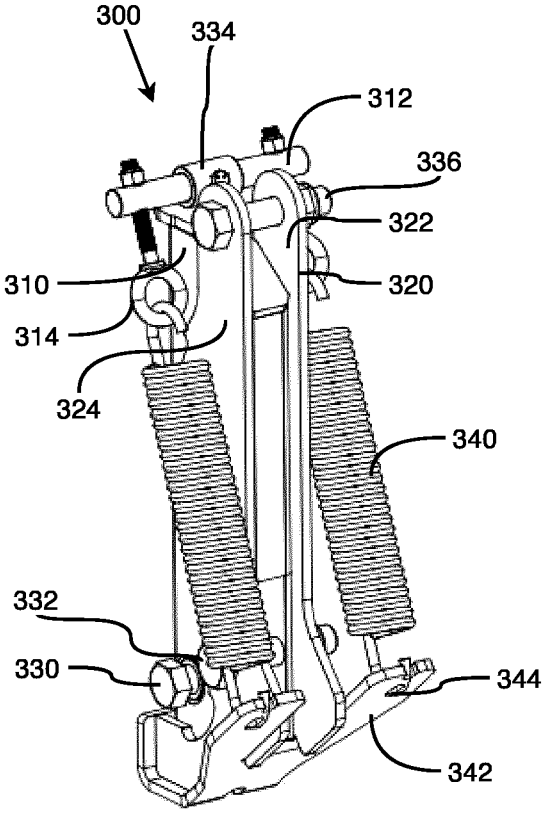
FIG. 3 is a perspective view of the trigger assembly in accordance with an embodiment.
Figure 4:
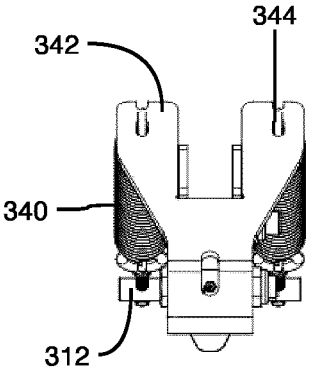
FIG. 4 is a bottom view of the trigger assembly of FIG. 3.

The extendable springs 340 are further attached at their top to the pin assembly comprising the pin member 312 and the sleeve 334. The pin assembly extends horizontally on both sides of the central portion static member. FIG. 3 further shows eyebolts 314 mounted to the pin member 312. The pin assembly is releasably attached to the holder assembly 150 to move concurrently with the blade 110. For clarity, the pin assembly is free to move relative to the nested arm 310 and the external arm 320; i.e., it is not attached to the static member.

Adjusting the length of the portion of the eyebolts 314 extending downward allows to adjust the force exerted by the extendable springs 340 between the eyebolts 314 and the anchoring point 344, thus the sensitivity of the trigger assembly 300.

The external arm 320 comprises two parallel plates 322, 324 providing a clearance therebetween for housing the nested arm 310.

It is worth noting that the pin member 312 is located frontward from top attachment point 336 of the external arm 320.

The trigger assembly 300 enters in a triggered position when a torque beyond a trigger threshold is applied to the pivoting attachment point 330 when the ground-contacting edge 116 of the blade 110 hits an obstacle. When triggered, the ground-contacting edge 116 tends to stay in place while the top edge 118 tends by inertia to continue its course forward. This results in the pin assembly rotating frontward (at its attachment point with the snow plow blade) relative to the pivoting attachment point 330, thereby being moving away from the external arm 320. In order for rotation to occur, the torque must exceed the force provided by the extendable springs 340 that extend further as rotation occurs.

Accordingly, as soon as the torque applied to the blade 110 is released or decreased under a certain level, the pin assembly, under the forces exerted by the extendable springs 340, tends to return to its default position, at its closest to the static member.

According to realizations, the number of spring-loaded trigger assemblies 300 may be of a single one, two or more.

According to realizations, the number, distribution and characteristics of the extendable spring(s) 340 may vary based on the desired sensitivity of the trigger assemblies 300, the extension designed to be undergone by the extendable spring(s) 340 when reaching the triggered position, etc.

According to realizations, the interfacing of components of the present snow plow blade assembly 100 comprises either releasable attachments (e.g., bolts and nuts, driven attachments such as hydraulic locks) or a combination of nestable components and releasable attachments ensuring that the nesting components remain nested until the releasable attachments are removed from the locking position.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. An attachment assembly for attaching a snow plow blade to a vehicle, comprising:

an interface bracket adapted for releasable connection with the vehicle;

an intermediate structure mounted to the interface bracket; and a trigger assembly comprising:

a static member comprising a pivoting attachment point, a top attachment point and a bottom attachment point, the pivoting attachment point for pivoting attachment to the snow plow blade, and the top and bottom attachment points for releasable attachment to the intermediate structure;

a pin assembly; and a biasing means attached, at one end, to the pin assembly and attached, at an other end, to the static member such that the trigger assembly is biased toward a default position in which the pin assembly and the static member are at their closest, wherein when applying a torque on the snow plow blade above a trigger threshold, the snow plow blade rotates from the default position to a triggered position, wherein the intermediate structure comprising an articulated assembly, wherein the static member has a distal end distant from the pivoting attachement point, and wherein the articulated assembly comprises a rear longitudinal bracket, a front longitudinal bracket pivotably mounted to the rear longitudinal bracket, and a top link arm, and further wherein the front longitudinal bracket is releasably attached to the pivoting attachment point, the rear longitudinal bracket is mounted to the interface bracket and the top link arm is releaseably attached to the distal end of the static member and pivotably mounted to the interface bracket.

2. The attachment assembly of claim 1, wherein the static member comprises a bottom end area and a top end area distal from the bottom end area, wherein the top attachment point is in the top end area and the bottom attachment point and the pivoting attachment point are in the bottom end area.

3. The attachment assembly of claim 2, wherein the static member comprises an anchoring point in the bottom end area and to which the other end of the biasing means is attached.

4. The attachment assembly of claim 3, wherein the one end of the biasing means is attached to the pin assembly forward of and above the bottom attachment point.

5. The attachment assembly of claim 1, wherein the pin assembly comprises a pin member and a sleeve in which the pin member is releasably secured.

6. The attachment assembly of claim 5, wherein the pin assembly further comprises an eyebolt to which the one end of the biasing means is attached.

7. The attachment assembly of claim 6, wherein the eyebolt is adjustable in length relative to the pin member and thereby adjusts a force exerted by the biasing means.

8. The attachment assembly of claim 1, wherein the top link arm is located above the front longitudinal bracket.

9. A trigger assembly for connecting a snow plow blade to an interface bracket, via an intermediate structure, the interface bracket for releasable connection to a vehicle, the trigger assembly comprising:

a static member comprising a pivoting attachment point, a top attachment point and a bottom attachment point, the pivoting attachment point for pivoting attachment to the snow plow blade, and the top and bottom attachment points for releasable attachment to the intermediate structure;

a pin assembly; and a biasing means attached, at one end, to the pin assembly and attached, at an other end, to the static member such that the trigger assembly is biased toward a default position in which the pin assembly and the static member are at their closest, wherein when applying a torque on the snow plow blade above a trigger threshold, the snow plow blade rotates from the default position to a triggered position, wherein the intermedia te structure comprises an articulate assembly, wherein the static member has a distal end distant from the pivoting attachment point, and wherein the articulated assembly comprises a rear longitudinal bracket, a front longitudinal bracket pivotably mounted to the rear longitudinal bracket, and a top link arm, and further wherein the front longitudinal bracket is releasably attached to the pivoting attachment point, the rear longitudinal bracket is mounted to the interface bracket and the top link arm is releasably attached to the distal end of the static member and pivotably mounted to the interface bracket.

10. The trigger assembly of claim 9, wherein the static member comprises a bottom end area and a top end area distal from the bottom end area, wherein the top attachment point is in the top end area and the bottom attachment point and the pivoting attachment point are in the bottom end area.

11. The trigger assembly of claim 10, wherein the static member comprises an anchoring point in the bottom end area and to which the other end of the biasing means is attached.

12. The trigger assembly of claim 11, wherein the one end of the biasing means is attached to the pin assembly forward of and above the bottom attachment point.

13. The trigger assembly of claim 9, wherein the pin assembly comprises a pin member and a sleeve in which the pin member is releasably secured.

14. The trigger assembly of claim 13, wherein the pin assembly further comprises an eyebolt to which the one end of the biasing means is attached.

15. The trigger assembly of claim 14, wherein the eyebolt is adjustable in length relative to the pin member and thereby adjusts a force exerted by the biasing means.

* * * * *